US008226202B2

(12) United States Patent
Hosono

(10) Patent No.: US 8,226,202 B2
(45) Date of Patent: Jul. 24, 2012

(54) FLUID EJECTING APPARATUS

(75) Inventor: Satoru Hosono, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 567 days.

(21) Appl. No.: 12/166,794

(22) Filed: Jul. 2, 2008

(65) Prior Publication Data

US 2009/0009553 A1 Jan. 8, 2009

(30) Foreign Application Priority Data

Jul. 6, 2007 (JP) ..... 2007-178353

(51) Int. Cl.
*B41J 2/165* (2006.01)

(52) U.S. Cl. ..... 347/20

(58) Field of Classification Search ..... None
See application file for complete search history.

(56) References Cited

U.S. PATENT DOCUMENTS

2006/0268054 A1* 11/2006 Sugahara ..... 347/35

FOREIGN PATENT DOCUMENTS

| | | |
|---|---|---|
| JP | 06-270400 | 9/1994 |
| JP | 2003-291374 | 10/2003 |
| JP | 2004-009685 | 1/2004 |
| JP | 2006-035537 | 2/2006 |

* cited by examiner

*Primary Examiner* — Matthew Luu
*Assistant Examiner* — Alejandro Valencia
(74) *Attorney, Agent, or Firm* — Workman Nydegger

(57) ABSTRACT

A fluid ejecting apparatus that ejects a fluid includes a storage portion that stores a fluid, a head, and a head capping device. The head discharges fluid supplied from the storage portion from a plurality of nozzles and includes a fluid discharging passage through which other fluid is discharged from the storage portion. The head capping device contacts the head and receives the fluid discharged from the plurality of nozzles and the fluid discharged through the fluid discharging passage. The head and the head capping device respectively include a head side flow passage and a head capping device side flow passage, which cooperatively form a circulation flow passage, through which the fluid that flows from the storage portion through the nozzles and the fluid discharged through the fluid discharging passage are returned back to the storage portion, in a state where the head capping device contacts the head.

7 Claims, 4 Drawing Sheets

FLUID EJECTING APPARATUS

BACKGROUND

1. Technical Field

The present invention relates to a technology for performing a preliminary discharge in a head of a fluid ejecting apparatus that ejects a fluid.

2. Related Art

In the existing art, there is an ink jet recording apparatus that has a line head. The line head discharges ink through nozzles to a recording sheet of paper, or the like, so that there is a possibility that, because ink is thickened around the nozzles or bubbles are trapped in the nozzles and, therefore, it may be difficult to smoothly discharge ink. Then, there has been proposed an ink jet recording apparatus that discharges ink from each nozzle, other than for printing, to thereby recover from a poor discharge of ink, that is, performs a so-called preliminary discharge (which is described in JP-A-2006-35537).

In general, the line head is formed so that a large number of (for example, a few thousands) nozzles are arranged in a direction along the width of a recording sheet of paper, or the like, so as to be able to discharge ink at the same time over the overall width of the recording sheet of paper, or the like. Thus, when ink is discharged from all the nozzles when the preliminary discharge is performed, a large amount of ink is used in the recording apparatus as a whole. Then, in the ink jet recording apparatus described in JP-A-2006-35537, ink, which has been discharged at the time of a preliminary discharge, is accumulated in a waste tank and then thrown away. Thus, there has been a problem that a large amount of waste ink that is not used for printing is consumed.

Note that the above problem not only applies to the line head ink jet recording apparatus but also applies to a serial head ink jet recording apparatus. In addition, the above problem not only occurs in the ink jet recording apparatus but also may possibly occur in a fluid ejecting apparatus that ejects a fluid other than ink (which includes liquid, a liquid body in which particles of functional material are dispersed, solid, such as fine particles, that may be ejected as a fluid).

SUMMARY

An advantage of some aspects of the invention is that it provides a technology for making it possible to suppress the amount of fluid that is consumed in a fluid ejecting apparatus when a preliminary discharge is performed.

The invention may be implemented as the following aspects or application examples.

FIRST APPLICATION EXAMPLE

A fluid ejecting apparatus that ejects a fluid includes a storage portion, a head, and a head capping device. The storage portion stores the fluid. The head discharges the fluid, which is supplied from the storage portion, from a plurality of nozzles and includes a fluid discharging passage through which the fluid is discharged from the storage portion not through the nozzles. The head capping device contacts the head and receives the fluid that is discharged from the plurality of nozzles and the fluid that is discharged through the fluid discharging passage. The head and the head capping device respectively include a head side flow passage and a head capping device side flow passage, both of which cooperatively form a circulation flow passage, through which the fluid that flows out from the storage portion through the nozzles and the fluid that is discharged through the fluid discharging passage are returned back to the storage portion, in a state where the head capping device is in contact with the head.

In the fluid ejecting apparatus according to the first application example, because the circulation flow passage, through which the fluid that flows out from the storage portion returns back to the tank, is formed in a state where the head is in contact with the head capping device, it is possible to reuse the fluid that is consumed when the preliminary discharge is performed, so that it is possible to suppress the amount of waste fluid.

SECOND APPLICATION EXAMPLE

In the fluid ejecting apparatus according to the first application example, the head side flow passage may include an inlet side flow passage portion that is provided at an inlet side of the nozzles, wherein the head capping device side flow passage may include an outlet side flow passage portion that is provided at an outlet side of the nozzles and the fluid discharging passage, and wherein the inlet side flow passage portion and the outlet side flow passage portion may be configured so that the flow rate of the fluid in the outlet side flow passage portion is faster than the flow rate of the fluid in the inlet side flow passage portion.

In this manner, while the fluid in the storage portion is discharged through the fluid discharging passage, a negative pressure that is applied from the inlet side flow passage portion to the outlet side flow passage portion is generated in each of the nozzles by a difference in flow rate between the inlet side flow passage portion and the outlet side flow passage portion, and, because of the negative pressure, the fluid that is supplied to the head side flow passage may be discharged through the nozzles to the head capping device side flow passage. Thus, it is possible to remove both the cause of poor discharge in the storage portion and the cause of poor discharge in the nozzle portion.

THIRD APPLICATION EXAMPLE

In the fluid ejecting apparatus according to the second application example, the cross-sectional area of the outlet side flow passage portion may be smaller than the cross-sectional area of the inlet side flow passage portion.

In this manner, the flow rate of the fluid in the outlet side flow passage portion may be faster than the flow rate of the fluid in the inlet side flow passage portion.

FOURTH APPLICATION EXAMPLE

In the fluid ejecting apparatus according to the third application example, the head side flow passage may have at least one pump.

In this manner, in comparison with the configuration that does not include a pump, it is possible to flow much more amount of the fluid in the head side flow passage.

FIFTH APPLICATION EXAMPLE

In the fluid ejecting apparatus according to the second application example, each of the head side flow passage and the head capping device side flow passage may have a pump, wherein the cross-sectional area of the outlet side flow passage portion may be substantially equal to the cross-sectional area of the inlet side flow passage portion, and wherein the amount of the fluid that flows through the pump provided in the head capping side flow passage per unit time may be larger than the amount of the fluid that flows through the pump provided in the head side flow passage per unit time.

In this manner, the flow rate of the fluid in the outlet side flow passage portion may be faster than the flow rate of the fluid in the inlet side flow passage portion.

SIXTH APPLICATION EXAMPLE

In the fluid ejecting apparatus according to any one of the first to fifth application examples, a scanning portion may be further provided, wherein the scanning portion, in a state where the head capping device is not in contact with the head, may allow at least one of a discharged object, onto which the fluid is discharged from the head, and the head to scan in a predetermined scanning direction, wherein the head may be a line head that is able to discharge the fluid at the same time over the overall width of the discharged object in a direction perpendicular to the scanning direction.

In this manner, in the fluid ejecting apparatus that has the line head, it is further effective to suppress the amount of fluid that is consumed when the preliminary discharge is performed.

SEVENTH APPLICATION EXAMPLE

In the fluid ejecting apparatus according to any one of the first to sixth application examples, the fluid may be a liquid.

In this manner, it is possible to remove bubbles and thickened liquid, which remain in the head, by performing the preliminary discharge.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an embodiment of the invention will be described in the following order on the basis of example embodiments.

A. First Example Embodiment
B. Second Example Embodiment
C. Third Example Embodiment
D. Alternative Example Embodiments

A. First Example Embodiment

Figure 1:
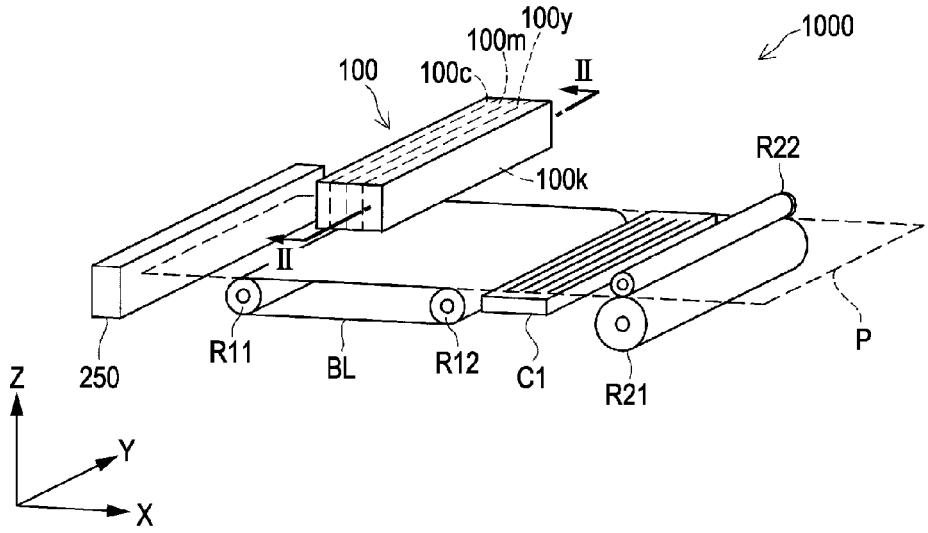
FIG. 1 is a perspective view that illustrates the schematic configuration of an ink jet printer, which serves as a fluid ejecting apparatus, according to an example embodiment of the invention.

FIG. 1 is a perspective view that illustrates the schematic configuration of an ink jet printer, which serves as a fluid ejecting apparatus, according to an example embodiment of the invention. The printer 1000 includes a head 100, a cap C1, a paper feed device 250, a paper transport belt BL, two belt driving rollers R11 and R12 that drive the paper transport belt BL, and two paper delivery rollers R21 and R22. The cap C1 is arranged between the paper transport belt BL and the paper delivery roller R21.

At the time when printing is performed, the paper feed device 250 feeds a printing sheet of paper P in a positive X direction. The paper transport belt BL further transports the printing sheet of paper, which has been fed out from the paper feed device 250, in the positive X direction. The printing sheet of paper P, which has been transported by the paper transport belt BL, is delivered through between the two paper delivery rollers R21 and R22. Here, the head 100 is fixed at a position above the upper face of the paper transport belt BL at the time when printing is performed, and the head 100 performs printing by discharging ink when the printing sheet of paper P is transported on the paper transport belt BL. Note that the paper transport belt BL and the two belt driving rollers R11 and R12 may be regarded as a scanning portion according to the aspects of the invention, and the positive X direction may be regarded as a predetermined scanning direction according to the aspects of the invention.

The head 100, when performing a preliminary discharge, is moved by a head actuator mechanism (not shown) to be brought into contact with the cap C1. The cap C1 receives ink that is discharged from the head 100 in the preliminary discharge. Note that the timing at which the preliminary discharge is performed may be, for example, a periodical timing when printing is being performed, a timing at which an instruction from a user is issued in a state where printing is not performed, a timing at which the power of the printer 1000 is turned on, or the like.

The head 100 is a so-called line head. The width (the length in the Y-axis direction) of the head 100 is slightly longer than the width of the printing sheet of paper P. The head 100 is able to discharge ink at the same time over the overall width of the printing sheet of paper P. The number of colors of ink discharged is four. The four colors include cyan (C) color, magenta (M) color, yellow (Y) color, and black (B) color. The head 100 is formed of four head portions that respectively correspond to inks (C, M, Y, and K) to be discharged, and the four head portions are aligned in the X-axis direction. Specifically, the head 100 includes a head portion 100*c* that discharges cyan ink, a head portion 100*m* that discharges magenta ink, a head portion 100*y* that discharges yellow ink, and a head portion 100*k* that discharges black ink. Note that the number of colors of ink discharged is not limited to four, but it may be selected, such as one or six.

Figure 2:
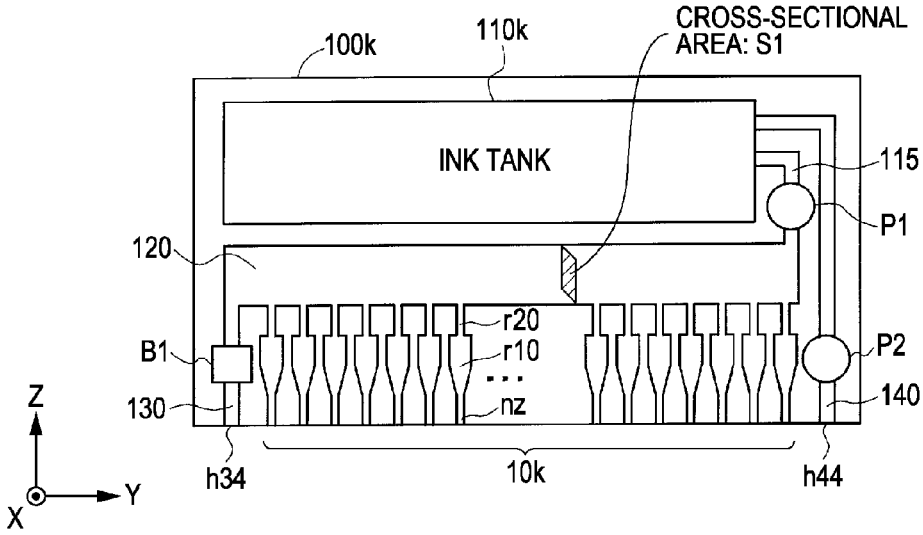
FIG. 2 is a cross-sectional view of a head portion, taken along the line II-II in FIG. 1.

FIG. 2 is a cross-sectional view of the head portion 100*k*, taken along the line II-II in FIG. 1. The head portion 100*k* includes an ink tank 110*k* that stores black ink, a plurality of nozzles nz that are aligned in the Y-axis direction, an ink supply flow passage 120, two pumps P1 and P2, a valve B1, an ink flow passage 115, an ink flow passage 130, and an ink flow passage 140. The ink tank may be regarded as a storage portion according to the aspects of the invention. Note that the ink tank 110*k* and the head portion 100*k* may be formed separately from each other.

One end of each of the nozzles nz is in fluid communication with a pressure chamber r10, and the other end reaches the outside of the head portion 100*k*. Thus, on the bottom face of the head portion 100*k*, a nozzle hole column 10*k* is formed to be aligned in the Y-axis direction. Each pressure chamber r10 is in fluid communication with the ink supply flow passage 120 through an ink flow passage r20. A piezoelectric vibrator (not shown), such as a piezoelectric element, is provided so as to be in contact with each pressure chamber r10. Ink droplets are discharged from each of the nozzles nz in such a manner that the pressure chamber r10 deforms by expansion and contraction of the piezoelectric vibrator, or the like. Note that, hereinafter, the nozzle nz, the pressure chamber r10 and the ink flow passage r20 are collectively referred to simply as "nozzle nz".

One end of the ink flow passage 115 is in fluid communication with the ink tank 110*k*, and the other end is in fluid communication with the ink supply flow passage 120 through the pump P1. In addition, one end of the ink flow passage 130 is in fluid communication with the ink supply flow passage 120 through the valve B1, and the other end reaches the outside of the head portion 100*k* to form an ink circulation hole h34. Note that the ink flow passage 130 may be regarded as a fluid discharging passage according to the aspects of the invention. One end of the ink flow passage 140 is in fluid communication with the ink tank 110*k* through the pump P2, and the other end reaches the outside of the head portion 100*k* to form an ink circulation hole h44.

The pump P1 feeds black ink, which is stored in the ink tank 110*k*, to the ink supply flow passage 120 through the ink flow passage 115. The pump P2, as will be described later, serves to return ink to the ink tank 110*k* through the ink flow passage 140. Here, the two pumps P1 and P2 both are metering pumps, and are configured to circulate a predetermined amount of ink per unit time. Note that the pump P1 and the pump P2 circulate the same amount of ink per unit time. These pumps P1 and P2 may employ, for example, a pump that generates a negative pressure in such a manner that a flow passage is deformed (narrowed) by a rotating pulley (not shown). The valve B1 is an electromagnetic valve. The valve B1 opens or closes in accordance with instructions from a control portion (not shown) and controls whether ink flows from the ink supply flow passage 120 to the ink flow passage 130. Specifically, the valve B1 is opened at the time of the preliminary discharge and is closed at the time other than the preliminary discharge. Note that a filter and a bubble removing portion (not shown) are provided upstream of the ink tank 110*k* and downstream of the pump P2, and removes impurities or bubbles from ink that returns to the ink tank 110*k*. Note that at least any one of the two pumps P1 and P2 may be omitted.

Here, the internal cross-sectional shape of the ink supply flow passage 120 may be, for example, a square having a side of 3 mm. In this case, the cross-sectional area S1 is 9 $mm^2$. In addition, the internal cross-sectional shape of the ink flow passage 130 may be, for example, a square having a side of 1 mm. Note that the internal cross-sectional shape of each of the ink supply flow passage 120 and the ink flow passage 130 is not limited to a square shape but it may be a selected shape, such as a rectangular shape or a circular shape.

The head portion 100*k* is described above; however, the other three head portions 100*c*, 100*m*, and 100*y* also have the same configuration.

Figure 3:
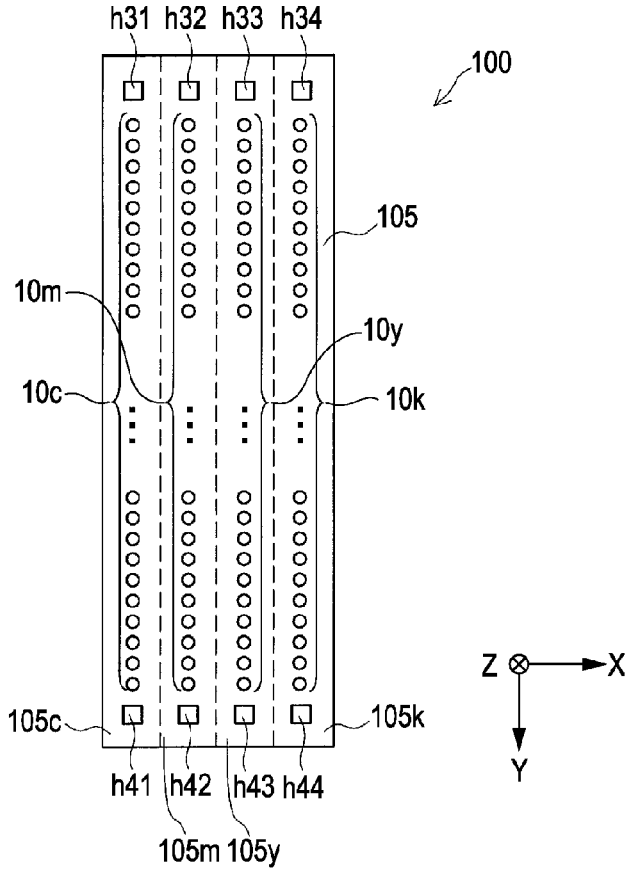
FIG. 3 is a bottom view of a head shown in FIG. 1.

FIG. 3 is a bottom view of the head 100 shown in FIG. 1. A nozzle plate 105 is arranged at the bottom of the head 100. The nozzle plate 105 includes four nozzle hole columns 10*c*, 10*m*, 10*y*, and 10*k*, each of which is formed of a plurality of nozzle holes that are aligned in the Y-axis direction. The nozzle hole column 10*c* is arranged in correspondence with the head portion 100*c* (see FIG. 1). Similarly, the nozzle hole column 10*m* is arranged in correspondence with the head portion 100*m*, the nozzle hole column 10*y* is arranged in correspondence with the head portion 100*y*, and the nozzle hole column 10*k* is arranged in correspondence with the head portion 100*k*.

The ink circulation hole h34 is provided at a position that is offset upward (negative Y direction) from the upper end of the nozzle hole column 10*k*. The ink circulation hole h34, as described above, constitutes one end of the ink flow passage 140 (see FIG. 2). On the other hand, the ink circulation hole h44 is provided at a position that is offset downward (positive Y direction) from the lower end of the nozzle hole column 10*k* (see FIG. 3). The ink circulation hole h44, as described above, constitutes one end of the ink flow passage 140 (see FIG. 2). Similarly, an ink circulation hole h31 and an ink circulation hole h41 are provided in correspondence with the nozzle hole column 10*c*, an ink circulation hole h32 and an ink circulation hole h42 are provided in correspondence with the nozzle hole column 10*m*, and an ink circulation hole h33 and an ink circulation hole h43 are provided in correspondence with the nozzle hole column 10*y*.

Figure 4:
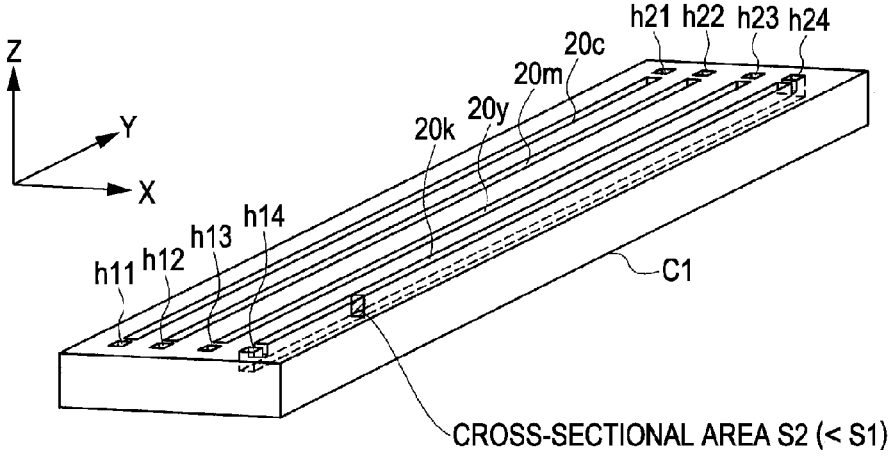
FIG. 4 is a perspective view that illustrates the detailed configuration of a cap shown in FIG. 1.

FIG. 4 is a perspective view that illustrates the detailed configuration of the cap C1 shown in FIG. 1. The size of the upper face of the cap C1 is substantially equal to the size of the nozzle plate 105 (see FIG. 3) that constitutes the bottom face of the head 100. Then, four grooves that extend in the longitudinal direction (Y-axis direction) are provided on the upper face of the cap C1 so as to be aligned in the X-axis direction. Specifically, an ink circulation groove 20*k* (see FIG. 4) is provided on the bottom face of the head 100 (see FIG. 3) at a position corresponding to the nozzle hole column 10*k*. Similarly, an ink circulation groove 20*c* is provided at a position corresponding to the nozzle hole column 10*c*, an ink circulation groove 20*m* is provided at a position corresponding to the nozzle hole column 10*m*, and an ink circulation groove 20*y* is provided at a position corresponding to the nozzle hole column 10*y*. Note that a seal portion (not shown) made of resin, such as silicon rubber, is provided around each of the ink circulation grooves 20*c*, 20*m*, 20*y*, and 20*k* to thereby ensure airtightness when the head 100 is in contact with the cap C1. Similarly, a seal portion (not shown) is also provided around each of the ink circulation holes h11 to h24.

The size (the length in the Y-axis direction and the cross-sectional area) of each of the ink circulation grooves 20*c*, 20*m*, 20*y*, and 20*k* is the same. Here, the cross-sectional shape of each of the ink circulation grooves 20*c*, 20*m*, 20*y*, and 20*k* may be, for example, a square having a side of 0.5 mm. In this case, the cross-sectional area S2 is 0.25 $mm^2$. Note that the cross-sectional shape is not only limited to the square shape, but it may be a selected shape, such as a rectangular shape or a circular shape (semi-circular shape).

An ink circulation hole h14 (see FIG. 4) is provided on the bottom face (see FIG. 3) of the head 300 at a position corresponding to the ink circulation hole h34. In addition, an ink circulation hole h24 is provided at a position corresponding to the ink circulation hole h44. Similarly, an ink circulation hole h11 is provided at a position corresponding to the ink circulation hole h31, an ink circulation hole h21 is provided at a position corresponding to the ink circulation hole h41, an ink circulation hole h12 is provided at a position corresponding to the ink circulation hole h32, an ink circulation hole h22 is provided at a position corresponding to the ink circulation hole h42, an ink circulation hole h13 is provided at a position corresponding to the ink circulation hole h33, and an ink circulation hole h23 is provided at a position corresponding to the ink circulation hole h43.

Here, each of the ink circulation holes h11 to h24 is formed to be a space having the same depth (the length in the Z-axis direction) as those of the ink circulation grooves 20*c*, 20*m*, 20*y*, and 20*k*. Then, each of the ink circulation holes h11 to h24 is in fluid communication with a corresponding one of the ink circulation grooves 20*c*, 20*m*, 20*y*, and 20*k* inside the cap C1. For example, the ink circulation hole h14 and the ink circulation hole h24 both are in fluid communication with the ink circulation groove 20*k* inside the cap C1. Note that the other ink circulation grooves 20*c*, 20*m*, and 20*y* also have the same configuration.

Figure 5:
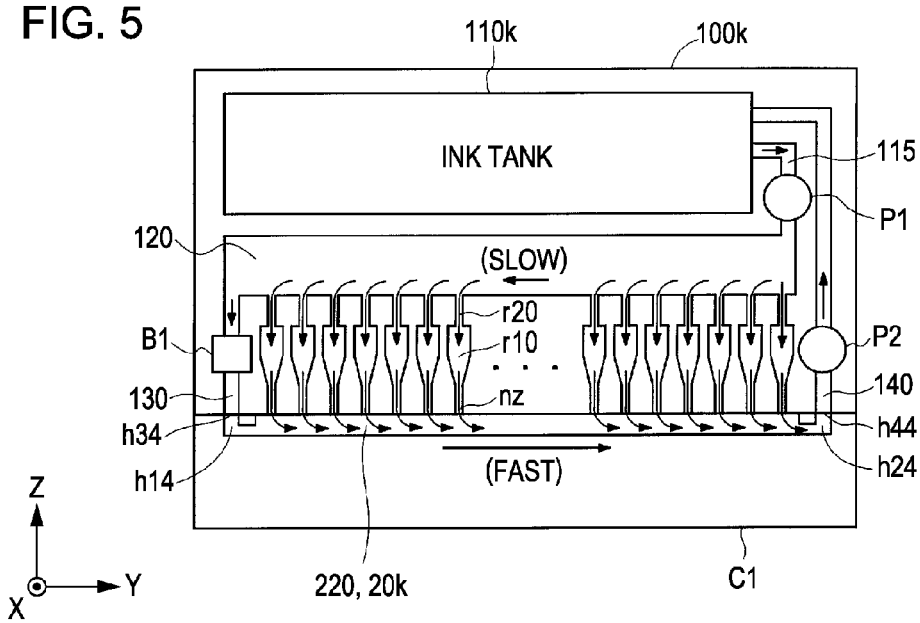
FIG. 5 is a view that schematically illustrates circulation of ink between the head portion and the cap at the time of a preliminary discharge.

FIG. 5 is a view that schematically illustrates circulation of ink between the head portion 100*k* and the cap C1 at the time of the preliminary discharge. Note that FIG. 5, as well as FIG. 2, is a cross-sectional view of the head portion 100*k* (and the cap C1 that is in contact with the head portion 100*k*), taken along the line II-II in FIG. 1.

In order to perform the preliminary discharge, the head 100 (see FIG. 1) moves to a position, at which the cap C1 is arranged, and then contacts the cap C1 from above. Then, a circulation flow passage of ink is formed so as to extend inside both the head 100 and the cap C1.

Specifically, in the head portion 100*k* (see FIG. 5), the ink circulation groove 20*k* contacts the nozzle plate 105 to thereby form an ink discharge flow passage 220. In addition, because each nozzle nz is in fluid communication with the ink discharge flow passage 220, the ink supply flow passage 120 and the ink discharge flow passage 220 are in fluid communication with the nozzles nz. In addition, as the ink circulation hole h44 contacts the ink circulation hole h24, the ink flow passage 140 and the ink discharge flow passage 220 are in fluid communication with each other. In this manner, the circulation flow passage is formed so as to extend from the ink tank 110*k* through the ink flow passage 115, the ink supply flow passage 120, the nozzles nz, the ink discharge flow passage 220 and the ink flow passage 140, in the stated order, back to the ink tank 110*k*. Note that, as the ink circulation hole h34 contacts the ink circulation hole h14, the ink flow passage 130 is in fluid communication with the ink discharge flow passage 220.

Note that the ink flow passage 115, the ink supply flow passage 120 and the ink flow passage 140 may be regarded as a head side flow passage. In addition, the ink circulation hole h14, the ink discharge flow passage 220 and the ink circulation hole h24 may be regarded as a head capping device side flow passage, the ink supply flow passage 120 may be regarded as an inlet side flow passage portion, and the ink discharge flow passage 220 may be regarded as an outlet side flow passage portion.

As the preliminary discharge is initiated through the instruction from the control portion (not shown), the valve B1 is opened. Thus, the ink supply flow passage 120 is in fluid communication with the ink discharge flow passage 220 through the ink flow passage 130. The pump P1 supplies black ink from the ink tank 110*k* to the ink supply flow passage 120 through the ink flow passage 115. Here, the diameter of each of the nozzles nz is 20 μm, which is much smaller than that of the ink flow passage 130. The resistance of flow passage of all the nozzles is still larger than that of the ink flow passage 130. Thus, ink flows through the ink supply flow passage 120 and the ink flow passage 130 to the ink discharge flow passage 220. Note that, in the above configuration, a flow passage that includes the ink flow passage 115, the ink supply flow passage 120 and the ink flow passage 130 may be regarded as a fluid discharging passage. Ink that flows into the ink discharge flow passage 220 is discharged through the ink discharge flow passage 220 to the ink flow passage 140. The pump P2 draws the ink discharged to the ink flow passage 140 and returns the ink to the ink tank 110*k*.

Here, the amount of ink that flows in the ink supply flow passage 120 per unit time is equal to the amount of ink that flows in the ink discharge flow passage 220 per unit time because the amount of ink that flows in each of the two metering pumps P1 and P2 is the same. In addition, when the cross-sectional area S1 (9 $mm^2$) of the ink supply flow passage 120 is compared with the cross-sectional area S2 (0.25 $mm^2$) of the ink discharge flow passage 220, the cross-sectional area S2 is relatively small. Thus, when the flow rate of ink at the time of the preliminary discharge is compared between in the ink supply flow passage 120 and in the ink discharge flow passage 220, the flow rate of ink is relatively fast in the ink discharge flow passage 220, and the flow rate of ink is relatively slow in the ink supply flow passage 120. Then, a negative pressure is generated and applied from the ink supply flow passage 120 to the ink discharge flow passage 220 in each of the nozzles nz. Thus, black ink that flows in the ink supply flow passage 120 flows into each of the nozzles nz and is then discharged to the ink discharge flow passage 220. That is, ink flows from the nozzles nz to the ink discharge flow passage 220 because of the flow of ink without passing through the nozzles (the flow from the ink supply flow passage 120 through the ink flow passage 130 to the ink discharge flow passage 220). Then, because ink is discharged from the nozzles nz while ink in the ink supply flow passage 120 is discharged through the ink flow passage 130, at this time, bubbles accumulated in each of the nozzles nz or thickened ink adhered around each of the nozzles nz is removed together with the ink to be discharged. In addition, because bubbles that remain in the ink supply flow passage 120 are discharged not through the small-diameter nozzles nz but through the ink flow passage 130, the bubbles are further easily removed. Note that the above described operation at the time of the preliminary discharge is not only performed in the head portion 100*k*, but also performed in the other head portions 100*c*, 100*m*, and 100*y*.

As described above, in the printer 1000, the head 100 contacts the cap C1 to thereby form the circulation flow passage of ink, and ink that is discharged through the preliminary discharge is returned to the ink tanks 110*c*, 110*m*, 110*y*, and 100*k*. Thus, it is possible to suppress the amount of ink that is consumed when the preliminary discharge is performed. In addition, the discharge of ink from each of the nozzles nz is performed using a negative pressure that is generated by a difference in flow rate of ink between in the ink supply flow passage 120 and in the ink discharge flow passage 220. Thus, it is not necessary to deform the pressure chambers 10 using the piezoelectric vibrators (not shown) in order to perform the preliminary discharge, so that it is possible to suppress degradation of each nozzle nz.

B. Second Example Embodiment

Figure 6:
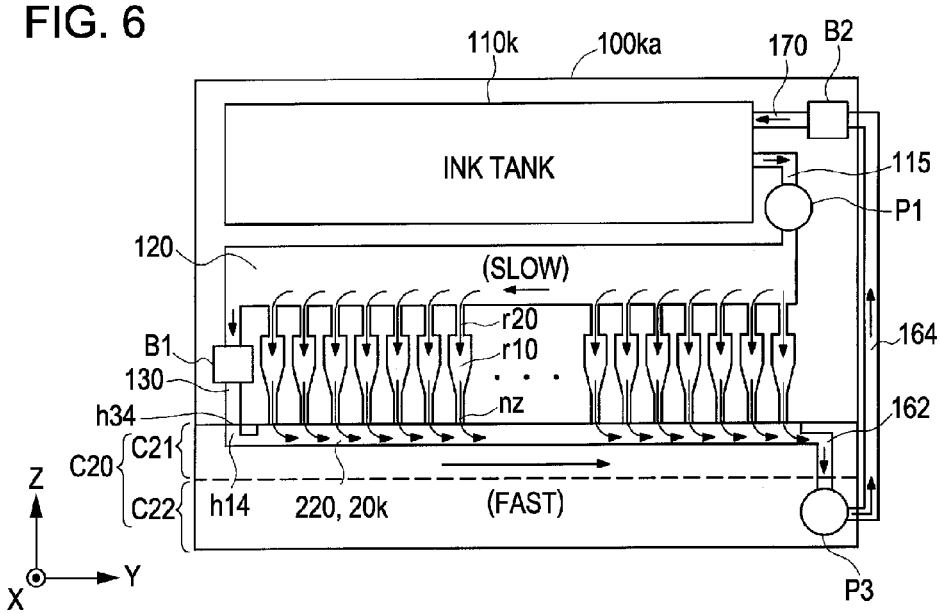
FIG. 6 is a view that schematically illustrates circulation of ink between the head portion and the cap at the time of a preliminary discharge according to a second example embodiment.

FIG. 6 is a view that schematically illustrates circulation of ink between the head portion and the cap at the time of the preliminary discharge according to a second example embodiment. A printer (not shown) according to the second example embodiment differs from the printer 1000 (see FIG. 1 and FIG. 5) according to the first example embodiment in that a path through which ink returns from the ink discharge flow passage 220 to the ink tank 110*k*; however, the other configuration is the same.

Specifically, a head portion 100*ka* according to the second example embodiment does not include the pump P2 or the ink flow passage 140. On the other hand, the head portion 100*ka* includes an ink flow passage 170 that is in fluid communication with the ink tank 110*k*. The ink flow passage 170 reaches the outside of the head 100 through a valve B2. The valve B2 is an electromagnetic valve. The valve B2 is opened at the time of the preliminary discharge and is closed at the time other than the preliminary discharge through the instruction from the control portion (not shown).

A cap portion C20 according to the second example embodiment is formed of a cap C21 and a suction portion C22. The suction portion C22 includes a pump P3. The amount of ink that can flow through the pump P3 per unit time is the same as that of the pump P1. The cap C21 is different from the cap C1 (see FIG. 4 and FIG. 5) in that the cap C21 does not include the ink circulation hole h24, but includes an ink discharge flow passage 162 that is connected to the pump P3. An ink flow passage 164 is provided outside the side face of the head portion 100*ka* and the cap portion C20. One end of the ink flow passage 164 is connected through the valve B2 to the ink flow passage 170. Note that a filter and a bubble removing portion (not shown) are provided in the ink flow passage 164, and removes impurities or bubbles from ink that returns to the ink tank 110*k*.

Ink that flows through the ink discharge flow passage 220 is discharged to the ink discharge flow passage 162 and is fed to the ink flow passage 164 by the pump P3. Then, ink that passes through the ink flow passage 164 is returned through the valve B2 and the ink flow passage 170 to the ink tank 110*k*.

The above configured printer according to the second example embodiment also has the same advantageous effects as those of the printer 1000 according to the first example embodiment. Note that, in the above described configuration according to the second example embodiment, it is also applicable that the cap C21 and the suction portion C22 are formed separately from each other and arranged at positions spaced apart from each other, and then they are connected by the ink discharge flow passage 162.

C. Third Example Embodiment

Figure 7:
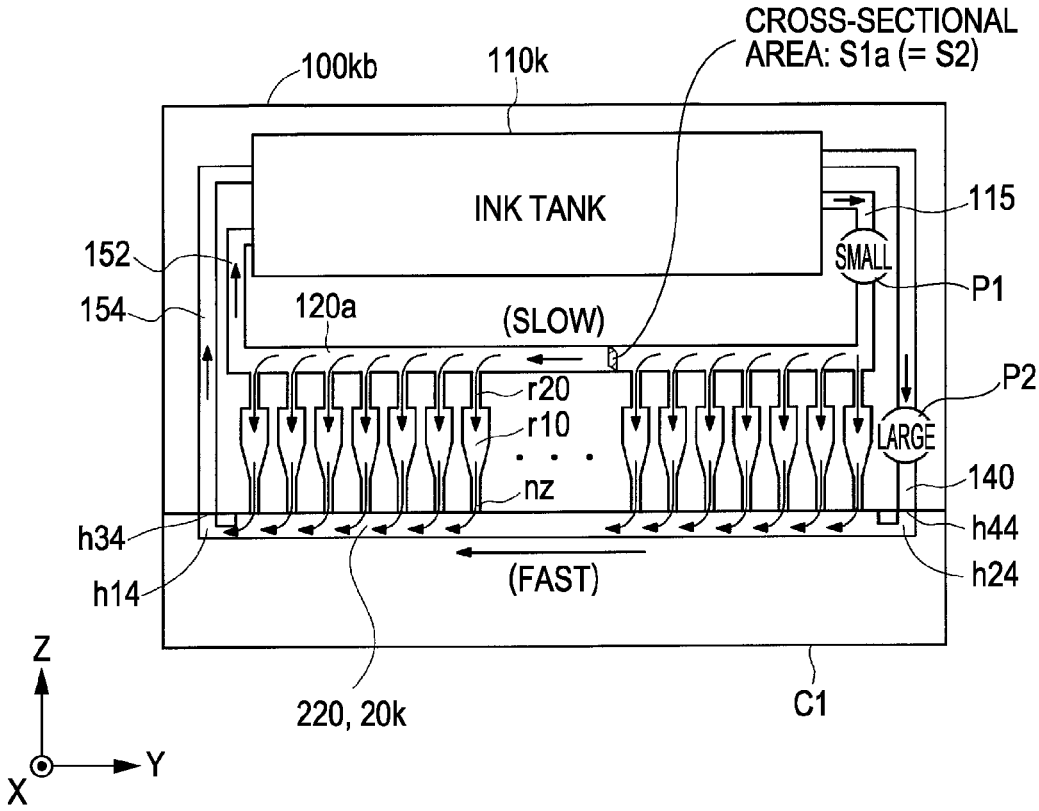
FIG. 7 is a view that schematically illustrates circulation of ink between the head portion and the cap at the time of a preliminary discharge according to a third example embodiment.

FIG. 7 is a view that schematically illustrates circulation of ink between the head portion and the cap C1 at the time of the preliminary discharge according to a third example embodiment. The head portion 100*kb* according to the third example embodiment differs from the head portion 100*k* (see FIG. 5) according to the first example embodiment in the following five points. That is, it differs in the cross-sectional area of the ink supply flow passage 120*a* that supplies ink to each of the nozzles nz, the amount of ink that flows through the two pumps P1 and P2, the configuration that the ink supply flow passage 120*a* is connected to the ink discharge flow passage 220, the path through which ink is supplied to the ink discharge flow passage 220, and the path through which ink is discharged from each of the ink supply flow passage 120*a* and the ink discharge flow passage 220. Note that the configuration of the head portions that correspond to the other three colors (C, M, and Y) other than the head portion 100*kb* is the same as that of the head portion 100*kb*. Then, the other configuration of the printer 100, such as the cap C1, is the same as that of the first example embodiment.

Specifically, the cross-sectional area S2*a* of the ink supply flow passage 120*a* is equal to the cross-sectional area of the ink discharge flow passage 220, and is 0.25 $mm^2$. In addition, in the two pumps P1 and P2, the amount of ink that flows per unit time is relatively small in the pump P1 and is relatively large in the pump P2. In addition, the ink supply flow passage 120*a* and the ink discharge flow passage 220 are in fluid communication only through the nozzles nz, and there is no path other than the nozzles nz. In addition, black ink is supplied from the ink tank 110*k* to the ink discharge flow passage 220 through the ink flow passage 140. Thus, the pump P2 flows ink in a direction opposite to that of the first example embodiment. Note that, in the above described configuration, the ink flow passage 140 may be regarded as a fluid discharging passage according to the aspects of the invention. In addition, ink discharged from the ink discharge flow passage 220 is returned through an ink flow passage 154 to the ink tank 110*k*. A filter and a bubble removing portion (not shown) are provided in the ink flow passage 154, and removes impurities or bubbles from ink that returns to the ink tank 110*k*. Note that one end of the ink supply flow passage 120*a* is in fluid communication with the ink discharge flow passage 152 that is connected to the ink tank 110*k*. Then, among ink that is supplied to the ink supply flow passage 120*a*, the remaining ink that is not discharged through the nozzles nz to the ink discharge flow passage 220 is returned through the ink discharge flow passage 152 to the ink tank 110*k*.

In the above configuration as well, the circulation flow passage is formed so as to extend from the ink tank 110*k* through the ink flow passage 115, the ink supply flow passage 120*a* and the nozzles nz to the ink discharge flow passage 220 and then from the ink discharge flow passage 220 through the ink flow passage 154 back to the ink tank 110*k*. In addition, the cross-sectional area of the ink supply flow passage 120*a* is equal to the cross-sectional area of the ink discharge flow passage 220, and the amount of ink that flows into the ink discharge flow passage 220 per unit time is larger than the amount of ink that flows into the ink supply flow passage 120*a* per unit time. Then, the flow rate of ink, as in the case of the above described example embodiments, is relatively fast in the ink discharge flow passage 220 and is relatively slow in the ink supply flow passage 120*a*. Thus, the printer according to the third example embodiment also has the same advantageous effects as those of the printer 1000 according to the first example embodiment.

D. Alternative Example Embodiments

Note that the components of the above described example embodiments, other than the components recited in the independent claim, are additional components and may be appropriately omitted. Note that the aspects of the invention are not limited to the example embodiments or embodiment described above, but they may be modified into various alternative embodiments without departing from the scope of the appended claims. The following alternative embodiments are, for example, applicable.

D1. First Alternative Embodiment

In the above first and second example embodiments, in order to create a difference in flow rate of ink between in the ink supply flow passage 120 and in the ink discharge flow passage 220, the cross-sectional area of the ink discharge flow passage 220 is set to be smaller than the cross-sectional area of the ink supply flow passage 120. In addition, in the third example embodiment, the cross-sectional area of the ink supply flow passage 120*a* is equal to the cross-sectional area of the ink discharge flow passage 220; however, the amount of ink that flows per unit time is set to be relatively large in the ink discharge flow passage 220, so that the above difference in flow rate of ink is created. However, the aspects of the invention are not limited to these configurations. For example, it is applicable that the cross-sectional area of the ink discharge flow passage is set to be larger than the cross-sectional area of the ink supply flow passage, and a difference in the amount of ink that flows per unit time between in the ink supply flow passage and in the ink discharge flow passage is set to be larger than that of the second example embodiment. That is, in general, in regard to the ink supply flow passage and the ink discharge flow passage that are in fluid communication through the nozzles nz, the fluid ejecting apparatus according to the aspects of the invention may employ a selected configuration such that the flow rate of ink in the ink discharge flow passage is faster than the flow rate of ink in the ink supply flow passage.

D2. Second Alternative Embodiment

In the above described embodiments, the discharge of ink from each of the nozzles nz at the time of the preliminary discharge uses a negative pressure that is generated by a difference in flow rate of ink between in the ink supply flow passage 120 and in the ink discharge flow passage 220; however, the aspects of the invention are not limited to it. For example, as in the case of regular printing, ink may be discharged using the piezoelectric vibrators (not shown). In the above configuration as well, because the discharged ink returns through the circulation flow passage back to each of the ink tanks 110*c*, 110*m*, 110*y*, and 110*k*, it is possible to suppress the amount of ink consumed when the preliminary discharge is performed. Note that, in the above configuration, in the first and second example embodiments, it is possible to omit the ink flow passage 130 (see FIG. 5 and FIG. 6) that supplies ink to the ink discharge flow passage 220 not through the nozzles nz. Then, when the preliminary discharge is performed, ink is initially discharged from the nozzles nz using the piezoelectric vibrators (not shown). Then, a negative pressure may be generated in the nozzles nz in such a manner that ink is drawn by the pump P2 after the ink has been accumulated in the ink discharge flow passage 220.

D3. Third Alternative Embodiment

In the above described third example embodiment, among ink that is supplied to the ink supply flow passage 120*a*, ink that is not discharged through the nozzles nz to the ink discharge flow passage 220 is returned through the ink discharge flow passage 152 to the ink tank 110*k;* however, the aspects of the invention are not limited to it. For example, the ink discharge flow passage 152 may be omitted, and all the ink that is supplied to the ink supply flow passage 120*a* may be discharged through the nozzles nz through the ink discharge flow passage 220. Note that, in the above configuration, it is applicable that the amount of ink that flows through the pump P1 is controlled, and the amount of ink that can be discharged through the nozzles nz to the ink discharge flow passage 220 is supplied to the ink supply flow passage 120*a*.

D4. Fourth Alternative Embodiment

In the above described example embodiments, ink is discharged in such a manner that the pressure chambers r10 are deformed in the nozzles nz through expansion and contraction of the piezoelectric vibrators (not shown), or the like, at the time of printing; however, a heater may be used instead of the piezoelectric vibrator.

D5. Fifth Alternative Embodiment

In the above described example embodiments, ink that is discharged from each of the nozzles nz directly returns through the ink flow passages 140, 164, or 154 to the ink tank 110*k;* however, the configuration that ink is indirectly returned to the ink tank 110*k* may be employed instead. For example, ink that has been used in the preliminary discharge may be temporarily accumulated in an ink recovery tank (not shown) that is provided separately from the ink tank 110*k*, and the accumulated ink may be returned from the ink recovery tank (not shown) through an exclusive flow passage (not shown) to the ink tank 110*k*. Note that it is also applicable that a user transfers the ink accumulated in the ink recovery tank (not shown) to the ink tank 110*k*. In addition, in the third example embodiment, among ink that is supplied to the ink supply flow passage 120*a*, the remaining ink that is not discharged through the nozzles nz to the ink discharge flow passage 220 may also be returned indirectly to the ink tank 110*k* as in the case of the above described ink discharged from each of the nozzles nz. In the above described configuration as well, it is possible to reuse ink that has been used in the preliminary discharge, so that it is possible to suppress the amount of waste ink.

D6. Sixth Alternative Embodiment

In the above described example embodiments, when printing is performed, the printing sheet of paper P is transported in the positive X direction while the position of the head 100 is fixed; however, it is also applicable instead that, while the position of the printing sheet of paper P is fixed, the head 100 is moved (scanned) in the X-axis direction to perform printing. In addition, it is also applicable that both the printing sheet of paper P and the head 100 are moved. That is, the fluid ejecting apparatus according to the aspects of the invention may employ the configuration such that at least one of the printing sheet of paper P and the head 100 scans in the scanning direction (X-axis direction). Note that, in the configuration that the head 100 moves (scans), an actuator mechanism (not shown) that moves the head 100 may be regarded as a scanning portion according to the aspects of the invention.

D7. Seventh Alternative Embodiment

In the above described example embodiments, the head 100 is a ling head; however, a serial head may be employed instead of the line head. In addition, a head that is formed of a plurality of serial heads that are arranged may be used. The head that is formed of the plurality of arranged serial heads may be, for example, a head that is formed of a plurality of serial heads that are aligned in a line in a direction (Y-axis direction in FIG. 1) perpendicular to a paper feeding direction or a head that is formed of a plurality of serial heads that are arranged in a staggered manner.

D8. Eighth Alternative Embodiment

In the above described example embodiments, the ink jet printer is described; however, the aspects of the invention are not limited to it. The aspects of the invention may be applied to a selected fluid ejecting apparatus that ejects a fluid other than ink (which includes liquid, a liquid body in which particles of functional material are dispersed, solid that may be flowed and ejected as a fluid). For example, the aspects of the invention may be applied to a liquid body ejecting apparatus that ejects an electrode material used for manufacturing a liquid crystal display, an EL (electroluminescent) display or a field emission display, or a liquid body that includes materials, such as color materials, which are dispersed or dissolved. In addition, the aspects of the invention may also be applied to a liquid ejecting apparatus that ejects a bio-organic material used for manufacturing a bio-chip, a liquid ejecting apparatus that ejects liquid, which is a sample, and that is used as a precision pipette, a liquid ejecting apparatus that ejects a lubricating oil pinpoint to a precision machine, such as a clock, a watch or a camera, a liquid ejecting apparatus that ejects a transparent resin liquid, such as an ultraviolet curing resin, for forming a microscopic semi-spherical lens (optical lens) used for an optical communication element, or the like, on a substrate, a liquid ejecting apparatus that ejects an etchant, such as acid or alkali, in order to perform etching on the substrate, or the like, and an ejecting apparatus that ejects solid, which is, for example, particles such as a toner.

What is claimed is:

1. A fluid ejecting apparatus that ejects a fluid, comprising:

a storage portion that stores the fluid;

a head that discharges the fluid, which is supplied from the storage portion, from a plurality of nozzles and that includes a fluid discharging passage through which the fluid is discharged from the storage portion not through the nozzles, wherein the fluid discharging passage is included entirely within the head and wherein the head includes a first ink circulation hole at an end of the fluid discharging passage opposite a head side flow passage, wherein the fluid discharging passage includes a valve having a first end in fluid communication with the head side flow passage and a second end in fluid communication with the first ink circulation hole; and a head capping device that contacts the head and that receives the fluid that is discharged from the plurality of nozzles and the fluid that is discharged through the fluid discharging passage and first ink circulation hole, wherein the head and the head capping device respectively include the head side flow passage and a head capping device side flow passage, both of which cooperatively form a circulation flow passage, through which the fluid that flows out from the storage portion through the nozzles and the fluid that is discharged through the fluid discharging passage and first ink circulation hole are returned back to the storage portion, in a state where the head capping device is in contact with the head, wherein a first end of the plurality of nozzles is in direct contact with the head side flow passage and a second end of the plurality of nozzles is in direct contact with the head capping device side flow passage in the state where the head capping device is in contact with the head, wherein the head capping device includes a second ink circulation hole and a third ink circulation hole and wherein the head capping device side flow passage includes at least one ink circulation groove that is located in the head capping device, wherein the second and third ink circulation holes are located at opposite ends of the at least one ink circulation groove, and wherein the second ink circulation hole is configured to match with the first ink circulation hole in the state where the head capping device is in contact with the head and the third ink circulation hole is configured to match with a fourth ink circulation hole located in the head in the state where the head capping device is in contact with the head.

2. The fluid ejecting apparatus according to claim 1, wherein the head side flow passage includes an inlet side flow passage portion that is provided at an inlet side of the nozzles, wherein the head capping device side flow passage includes an outlet side flow passage portion that is provided at an outlet side of the nozzles and the fluid discharging passage, and wherein the inlet side flow passage portion and the outlet side flow passage portion is configured so that the flow rate of the fluid in the outlet side flow passage portion is faster than the flow rate of the fluid in the inlet side flow passage portion.

3. The fluid ejecting apparatus according to claim 2, wherein the cross-sectional area of the outlet side flow passage portion is smaller than the cross-sectional area of the inlet side flow passage portion.

4. The fluid ejecting apparatus according to claim 3, wherein the head side flow passage has at least one pump.

5. The fluid ejecting apparatus according to claim 2, wherein each of the head side flow passage and the head capping device side flow passage has a pump, wherein the cross-sectional area of the outlet side flow passage portion is substantially equal to the cross-sectional area of the inlet side flow passage portion, and wherein the amount of the fluid that flows through the pump provided in the head capping side flow passage per unit time is larger than the amount of the fluid that flows through the pump provided in the head side flow passage per unit time.

6. The fluid ejecting apparatus according to claim 1, further comprising a scanning portion that, in a state where the head capping device is not in contact with the head, allows at least one of a discharged object, onto which the fluid is discharged from the head, and the head to scan in a predetermined scanning direction, wherein he head is a line head that is able to discharge the fluid at the same time over the overall width of the discharged object in a direction perpendicular to the scanning direction.

7. The fluid ejecting apparatus according to claim 1, wherein the fluid is a liquid.

* * * * *